US005221026A

United States Patent [19]

Williams

[11] Patent Number: 5,221,026

[45] Date of Patent: Jun. 22, 1993

[54] APPARATUS FOR DISPENSING MIXTURES OF LIQUIDS AND PRESSURIZED GAS

[76] Inventor: Monte Williams, 821 Sweetleaf Dr., Monroeville, Pa. 15146

[21] Appl. No.: 776,965

[22] Filed: Oct. 15, 1991

[51] Int. Cl.[5] ..... B67D 5/00

[52] U.S. Cl. ..... 222/144.5; 222/145; 222/401; 239/304; 239/366; 137/606

[58] Field of Search ..... 239/305, 307, 366, 372, 239/373, 304; 222/132, 401, 144.5, 145; 137/606; 138/111, 113, 114

[56] References Cited

U.S. PATENT DOCUMENTS

| | | | |
|---|---|---|---|
| 773,852 | 11/1904 | Cutting | 239/142 |
| 1,198,045 | 9/1916 | Miller | 239/416.1 X |
| 1,434,569 | 11/1922 | Sullivan | 239/434 X |
| 1,537,566 | 5/1925 | Temple | 239/434 |
| 1,567,220 | 12/1925 | Williamson | 239/135 |
| 1,953,330 | 4/1934 | Andres | 239/307 |
| 2,931,580 | 4/1960 | Johnson | 239/346 |
| 2,941,900 | 6/1960 | Schröder-Stranz | 239/307 |
| 2,943,797 | 7/1960 | Neilson | 239/305 |
| 3,058,668 | 10/1962 | Harmes et al. | 239/416.1 X |
| 3,059,858 | 10/1962 | Linder | 239/413 |
| 3,149,783 | 9/1964 | Sosnick | 239/434 |
| 4,005,825 | 2/1977 | Schowiak | 239/413 |
| 4,029,260 | 6/1977 | Herrick | 239/282 |
| 4,113,182 | 9/1978 | Brago | 239/304 |
| 4,505,431 | 3/1985 | Huffman | 239/434 X |
| 4,978,029 | 12/1990 | Furrow et al. | 222/145 X |

FOREIGN PATENT DOCUMENTS

| | | | |
|---|---|---|---|
| 627410 | 9/1961 | Canada | 239/307 |
| 16802 | 5/1956 | Fed. Rep. of Germany | 239/434 |
| 2254447 | 5/1974 | Fed. Rep. of Germany | 239/307 |
| 251926 | 12/1987 | German Democratic Rep. | 239/413 |

*Primary Examiner*—Andres Kashnikow
*Assistant Examiner*—A. Pomrening
*Attorney, Agent, or Firm*—Kirkpatrick & Lockhart

[57] ABSTRACT

An apparatus for a liquid and pressurized gas includes a gas inlet hose for conducting the pressurized gas therethrough, a liquid inlet hose, extending through the interior of the gas inlet hose, for conducting the liquid therethrough, a hose separator connected to an end of the gas and liquid inlet hoses, a gas outlet hose connected through the hose separator so as to be in fluid communication with the gas inlet hose for further conducting the pressurized gas therethrough, a liquid outlet hose, separate from the gas outlet hose, connected through the hose separator so as to be in fluid communication with the liquid inlet hose for further conducting the liquid therethrough, and a main outlet hose connected to and in fluid communication with the liquid outlet hose and the gas outlet hose. The apparatus further includes a first valve positioned within the liquid outlet hose to regulate flow therethrough and a second valve positioned within the gas outlet hose to regulate flow therethrough.

12 Claims, 6 Drawing Sheets

APPARATUS FOR DISPENSING MIXTURES OF LIQUIDS AND PRESSURIZED GAS

BACKGROUND OF THE INVENTION

1. Field of the Invention

The present invention relates to a dispensing apparatus, and more particularly to a dispensing apparatus for dispensing liquids, pressurized gas, and mixtures of liquids and pressurized gas in various concentrations.

2. Description of the Background of the Invention

Various devices exist for dispensing mixtures of liquids and pressurized gas. For example, U.S. Pat. No. 4,005,825 to Schowiak discloses an apparatus whereby the individual components of a multiple component sprayable fluid are conducted through separate lines to a hand-held unit, mixed in a mixing manifold, and are subsequently atomized in an air atomizing spray gun by air conducted through a separate line. U.S. Pat. No. 3,059,858 to Linder discloses an applicator system whereby compressed air, detergent and water travel through separate lines to a hand-held unit. The liquid detergent and water lines may be turned off, permitting an air alone operation.

Devices such as these allow chemicals or liquids to remain unmixed until just before they are dispensed as a mixture or aerosol. Unfortunately, they also entail at least three or more separate lines running to a hand-held unit. Specifically, those devices require a separate hose for conducting pressurized air to be run from a pressurized air source to a hand held device. Furthermore, such a large number of lines running to a hand-held unit tends to make the unit much more cumbersome and difficult to use. Such devices often require separate sources of air pressure for forcing the liquid through the various hoses and for mixing with the liquids in the hand held devices to propel the liquids in the form of an aerosol.

Other devices overcome at least one of these problems in that a single source of pressurized air is used as both as a mixing agent and as a means to pressurize the liquid(s). For example, U.S. Pat. No. 773,852 to Cutting discloses a powder and liquid distributing device wherein air from a single source of pressurized air is supplied separately to both a chemical discharge chamber to aid in moving the chemicals along distributing pipes, and to a hand-held atomizing unit to atomize a chemical as it leaves a distributing pipe. East German patent Publication No. 251,926 discloses a device whereby a supply of pressurized air is supplied separately to a spray gun and to a fluid reservoir to pressurize fluid in the reservoir. Those devices still have the disadvantage, however, that they require a separate air hose running to a hand-held unit, and therefore present more cumbersome and difficult to use hand-held units.

U.S. Pat. No. 1,537,566 to Temple discloses a painting device in which compressed air is supplied to a tank to pressurize the paint. The pressurized air is then taken from the tank to a paint spray nozzle. An air hose extends within a paint hose over at least a portion of their respective lengths so that only one line extends toward the spray nozzle over at least a portion of the length of the hoses. However, the air and paint hoses come out of the tank separately and thus form two lines along a beginning portion of their lengths which tends to increase the complexity of the device. Also, the device does not include control valves for the air and paint lines near the spray nozzle, which makes it difficult for a user to quickly control the flows of air and paint.

SUMMARY OF THE INVENTION

In accordance with the present invention, an apparatus for dispensing a liquid and pressurized gas is provided. The apparatus comprises a gas inlet hose for conducting the pressurized gas therethrough and a liquid inlet hose for conducting the liquid therethrough in the same direction in which the gas is conducted. The liquid inlet hose extends through the interior of the gas inlet hose. A hose separator is connected to one end of both the gas and liquid inlet hoses. A liquid outlet hose is connected through the hose separator so as to be in fluid communication with the liquid inlet hose for further conducting the liquid therethrough. A gas outlet hose is connected through the line separator so as to be in fluid communication with the gas inlet hose for further conducting the pressurized gas therethrough. A main outlet hose is connected to and in fluid communication with the liquid outlet hose and the gas outlet hose.

The apparatus of the present invention also provides a first valve positioned within the liquid outlet hose to regulate flow therethrough, and a second valve positioned within the gas outlet hose to regulate flow therethrough. The main outlet hose includes an upstream end and a downstream end, with the liquid outlet hose being connected to the upstream end of the main outlet hose and the gas outlet hose being connected to the downstream end of the main outlet hose. Thus, pressurized gas can be controllably mixed with the liquid being dispensed. The apparatus further provides a tank for containing a supply of a liquid in a lower portion thereof and a supply of pressurized gas in an upper portion thereof, wherein the liquid inlet hose extends into the lower portion of the tank for conducting the liquid therefrom and a second end of the gas inlet hose is connected to the upper portion of the tank for conducting the pressurized gas therefrom.

According to another embodiment of the present invention, a secondary tank containing a secondary liquid in the lower portion thereof may be provided. In that embodiment, a secondary liquid inlet hose for conducting the secondary liquid therethrough is provided wherein the secondary liquid inlet hose extends into the lower portion of the secondary tank for conducting the secondary liquid therefrom. The secondary liquid inlet hose extends through the interior of the gas inlet hose and a first end of a secondary liquid outlet hose is connected through the hose separator so as to be in fluid communication with the secondary liquid inlet hose for further conducting the secondary liquid therethrough. The second end of the secondary liquid outlet hose is connected to the main outlet hose. In that embodiment, a third valve is positioned within the secondary liquid outlet hose to regulate flow therethrough. Multiple secondary tanks configured in a similar manner are also contemplated and are within the principle and scope of the present invention.

Accordingly, the present invention provides solutions to the foregoing problems. The apparatus of the present invention is relatively easy to use in that only one source of pressurized air is required. Furthermore, no separate air hose is required and consequently only one hose extends from the tanks to the hand held apparatus. Still further, separate controls are provided so that the concentrations of liquids and air may be varied.

The apparatus may thus dispense air only, liquid only, or various concentrations of air and liquid. Those and other advantages and benefits of the present invention will become apparent from the Detailed Description of the Preferred Embodiment hereinbelow.

BRIEF DESCRIPTION OF THE DRAWINGS

For the present invention to be clearly understood and readily practiced, a preferred embodiment will now be described, by way of example only, wherein.

DETAILED DESCRIPTION OF THE PREFERRED EMBODIMENT

Figure 1:
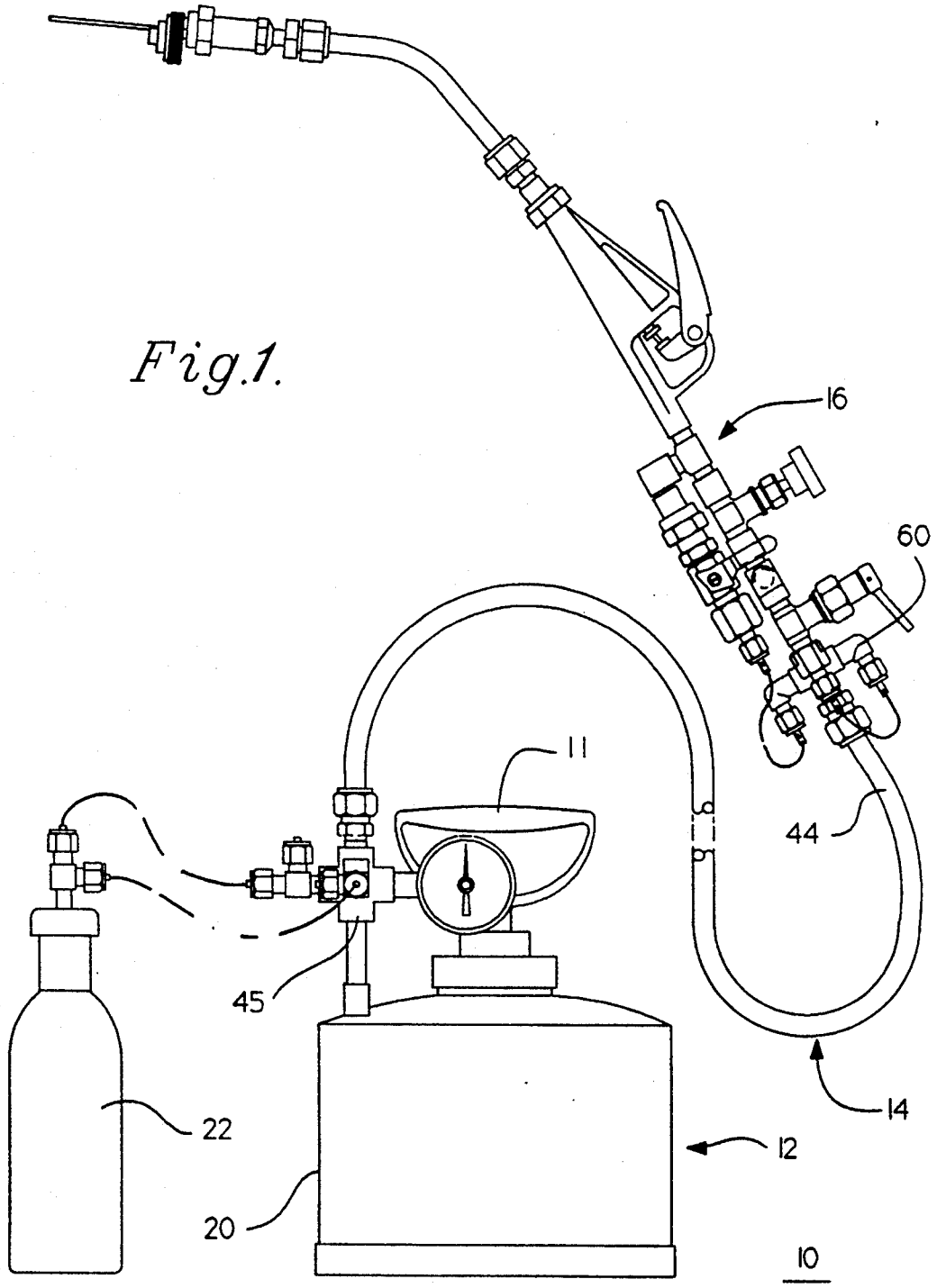
FIG. 1 is a front elevational view of a dispensing apparatus in accordance with the present invention.

With reference to FIG. 1, there is shown a dispensing apparatus 10 constructed in accordance with the present invention which includes a tank assembly 12, an inlet line assembly 14, and a hand-held dispensing assembly 16. While the present invention will be described in the context of an apparatus for dispensing chemical insecticides, it is not intended to exclude other possible applications including, but not limited to, paint dispensing, cleaning agent dispensing, and the like.

Figure 2:
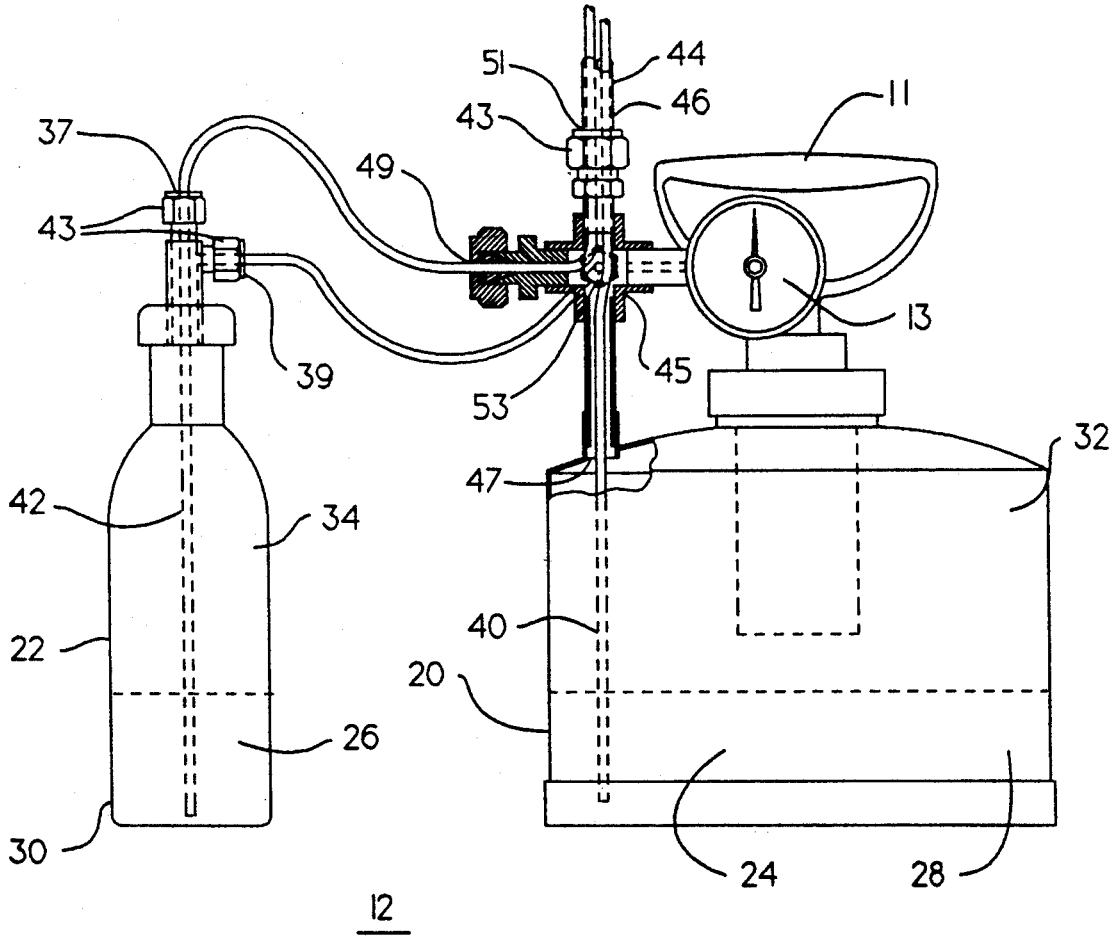
FIG. 2 is a partial cross-sectional view of a tank assembly of the dispensing apparatus of FIG. 1.

As shown in FIG. 2, the tank assembly 12 may include a plurality of tanks and preferably includes one to three tanks. For the purposes of illustration only, a dispensing apparatus 10 comprising two tanks will be described herein. Two tanks 20, 22 each include a supply of a chemical or other liquid 24, 26 in a lower portion 28, 30, respectively, thereof. The primary tank 20 may, for example, be constructed of 316 stainless steel and preferably has a capacity of one, two, or three gallons. The secondary tank 22 may, for example, be constructed from chrome plated brass and preferably is of a capacity of forty-eight fluid ounces. The tanks 20, 22 also each include a supply of a pressurized gas, preferably pressurized air at a pressure of 175 psi, in an upper portion 32, 34 thereof, respectively. The air may be pressurized by simple hand pumping means such as a plunger 11. A pressure gauge 13 may be used to measure pressure in the primary tank 20. The chemicals 24, 26 may be any liquids or combinations thereof suitable for the intended application. For example, if three tanks (a primary tank 20, a first secondary tank 22, and an additional secondary tank (not shown)) are used, such an application could consist of one tank containing a residual, a second tank containing a flushing agent, and a third tank containing an insect growth regulator. It will be understood that the height of each lower portion 28, 30 will vary with the amount of chemicals contained in each tank 20, 22.

As shown in FIGS. 1 and 2, the inlet hose assembly 14 extends from the tank assembly 12 to the dispensing assembly 16, and serves to inlet the chemicals 24, 26 and the pressurized gas from the tanks 20, 22 to the dispensing assembly 16. The inlet hose assembly 14 includes a first chemical inlet hose 40 which extends into the lower portion 28 of the first tank 20, a secondary chemical inlet hose 42 which extends into the lower portion 30 of the second tank 22, and a gas inlet hose 44. The inlet hose assembly 14 may be, for example, ten feet in length although lengths up to one hundred feet may be made. The chemical inlet hoses 40, 42 are preferably constructed of 1/8 inch diameter nylon tubing. Unless otherwise specified, preferred diameter measurements of tubing referenced herein refer to outside diameter. The gas inlet hose 44 is preferably constructed of ¼ inch or ½ inch diameter nylon tubing, depending on the number of chemical inlet hoses 40, 42 being used.

A multi-port connector 45 comprising a primary inlet port 47, multiple secondary inlet ports 49, a primary outlet port 51, and multiple secondary output ports 53 may be used to provide hose connecting means connecting the inlet hose assembly 14 with the tanks 20, 22. Threaded hose connectors 43 of the appropriate diameter, which provide an airtight connection, may be used to secure the various hoses to the multi-port connector 45 as described herein. It will be understood by those skilled in the art that other accessories, for example, an air bleed valve, tank isolation valve, and the like may be added to additional ports on a multi-port connector.

Figure 6:
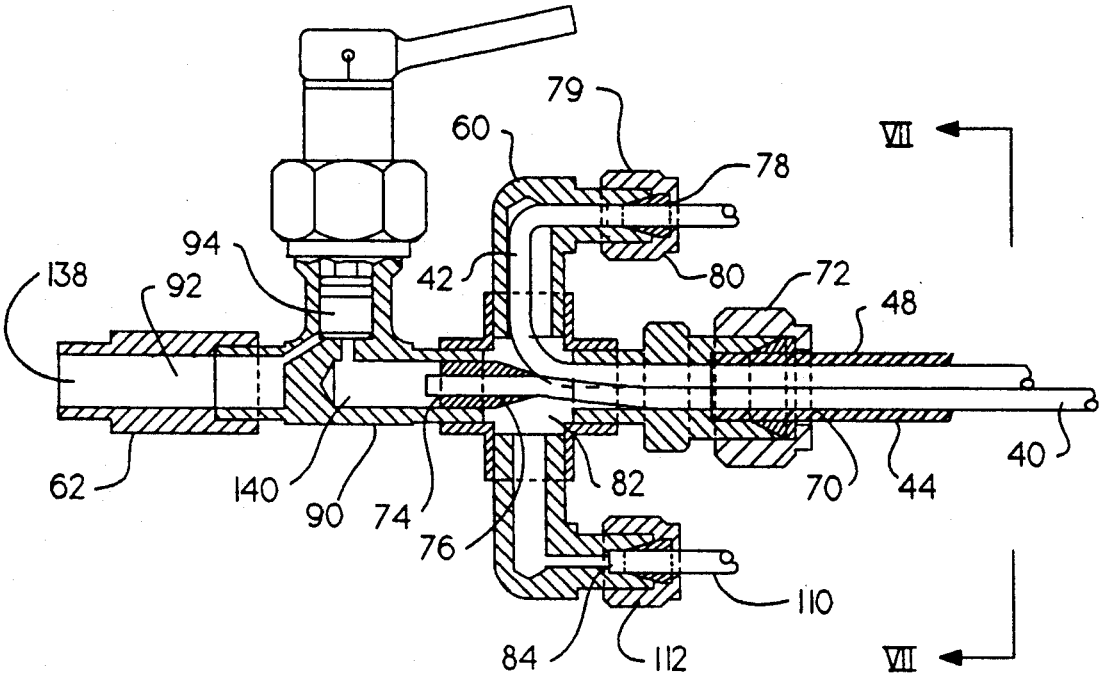
FIG. 6 is a partial cross-sectional view of a line separator of the hand-held dispensing assembly of FIG. 3.

The primary inlet port 47 is connected to the primary tank 20 thereby forming an airtight connection. The gas inlet hose 44 has a first end 46 and a second end 48, as seen in FIGS. 2 and 6, with the first end 46 connected in a gas-tight manner to the primary outlet port 51 of the multi-port connector 45 and the second end 48 connected to the hand-held dispensing assembly 16, which is described hereinbelow.

The chemical inlet hose 40 extends out of the tank 20, through primary inlet port 47, out primary outlet port 51, into the first end 46 of the gas inlet hose 44, through the interior of the gas inlet hose 44, and out of the second end 48 of the gas inlet hose 44. The secondary chemical inlet hose 42 extends out of the tank 22, through an outlet port 37, is threaded into one of the secondary inlet ports 49 of the multi-port connector 45, out primary outlet port 51, and then extends into the first end 46 of gas inlet hose 44. The secondary chemical inlet hose 42 thereafter extends through the length of the gas inlet hose 44 and out of the second end 48 of the gas inlet hose 44. Because the chemical inlet lines 40, 42 extend into the lower portions 28, 30 of the tanks 20, 22, they are in fluid communication with the supplies of chemicals 24, 26 in the tanks 20, 22 respectively. Because the gas inlet hose 44 is connected to the second portion 32 of the tank 20, it is in fluid communication with the supply of pressurized gas therein such that pressurized gas can be conducted within the gas inlet hose 44 external to the chemical and secondary chemical inlet hoses 40, 42. The flow of pressurized gas through the gas inlet hose 44 is thus in the same direction as the flow of chemicals through chemical inlet hoses 40 and 42.

It will be understood that for effective operation, the upper portion 34 of the secondary tank 22 must be filled with a pressurized gas to force the flow of liquid through the secondary chemical inlet hose 42. Such pressure may be supplied in a number of ways. In a preferred embodiment, the upper portion 34 of the secondary tank 22 receives a supply of pressurized air through an air hose 41 which extends from a secondary outlet port 53 of the multi-port connector and into an air supply inlet port 39 which is in air-tight connection to the upper portion 34 of the secondary tank 22. Thus, a single source of pressurized air may be used for multi-tank operation. Accessories, such as an air bleed valve (not shown), tank isolation valve (not shown), and the like, may be connected to the secondary tank 22.

Figure 3:
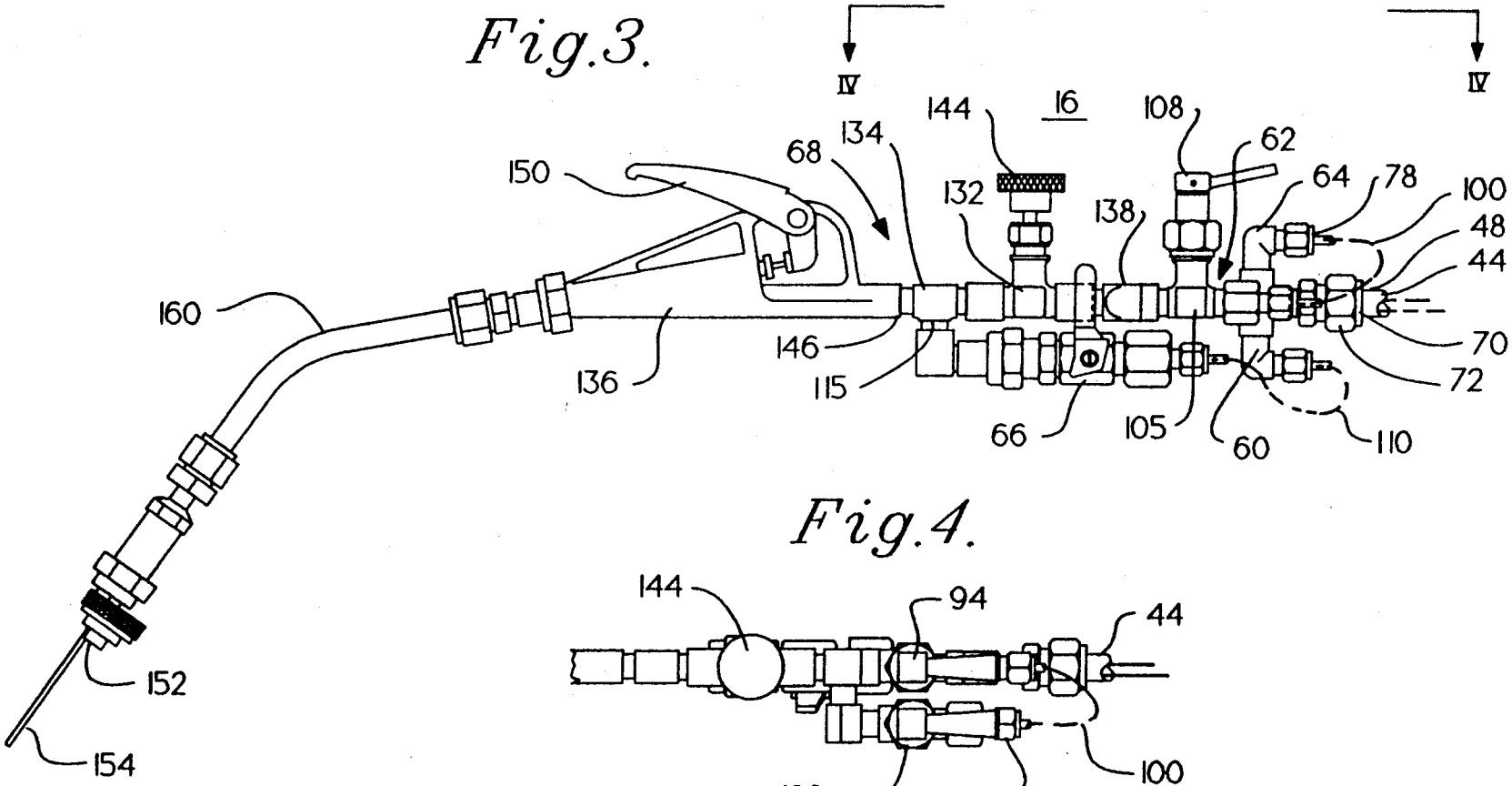
FIG. 3 is a front elevational view of a hand-held dispensing assembly of the dispensing apparatus of FIG. 1.
Figure 4:
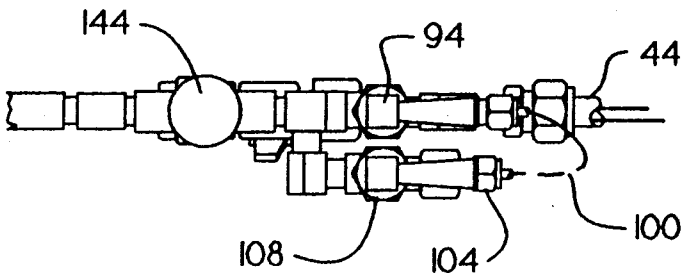
FIG. 4 is a side elevational view of a hand-held dispensing assembly taken along the line IV—IV in FIG. 3.
Figure 7:
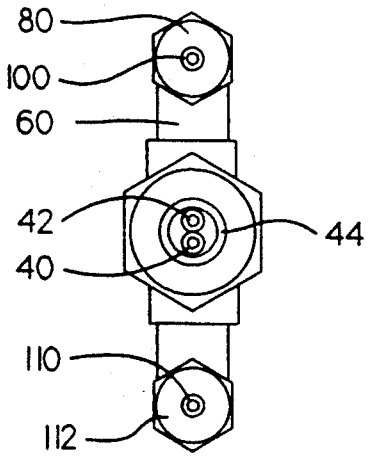
FIG. 7 is a cross-sectional view of a line separator as seen along line VII—VII of FIG. 6.

As seen in FIG. 3 and FIG. 7, the dispensing assembly 16 includes a hose separator 60, a chemical outlet portion 62, a secondary chemical outlet portion 64, a gas outlet portion 66, and a main outlet portion 68. The hose separator 60 acts to direct the air flow in the gas outlet hose 44 as described below and to direct the chemical inlet hoses 40, 42 to the various portions of the dispensing assembly 16. The line separator may, for example, be a NPT street or male pipe T-fitting. As shown in FIGS. 3 and 6, the gas outlet portion 66 includes the second end 48 of the gas outlet hose 44 which is held in gas-tight connection with an inlet port 70 of the hose separator 60 by a threaded hose connector 72. The interior of the gas inlet hose is in fluid communication with an interior 82 of the hose separator 60 such that the gas inlet hose 44 is in fluid communication with a gas outlet port 84 of the hose separator 60. As seen in FIG. 6, the gas outlet portion 66 includes a gas outlet hose 110, the first end of which is connected in a gas-tight manner to the gas outlet port 84 of the hose separator 60 by a threaded connector 112. The gas outlet hose 110 is preferably constructed of 3/16 inch diameter rigid nylon tubing.

Figures 5A, 5B, 5C:
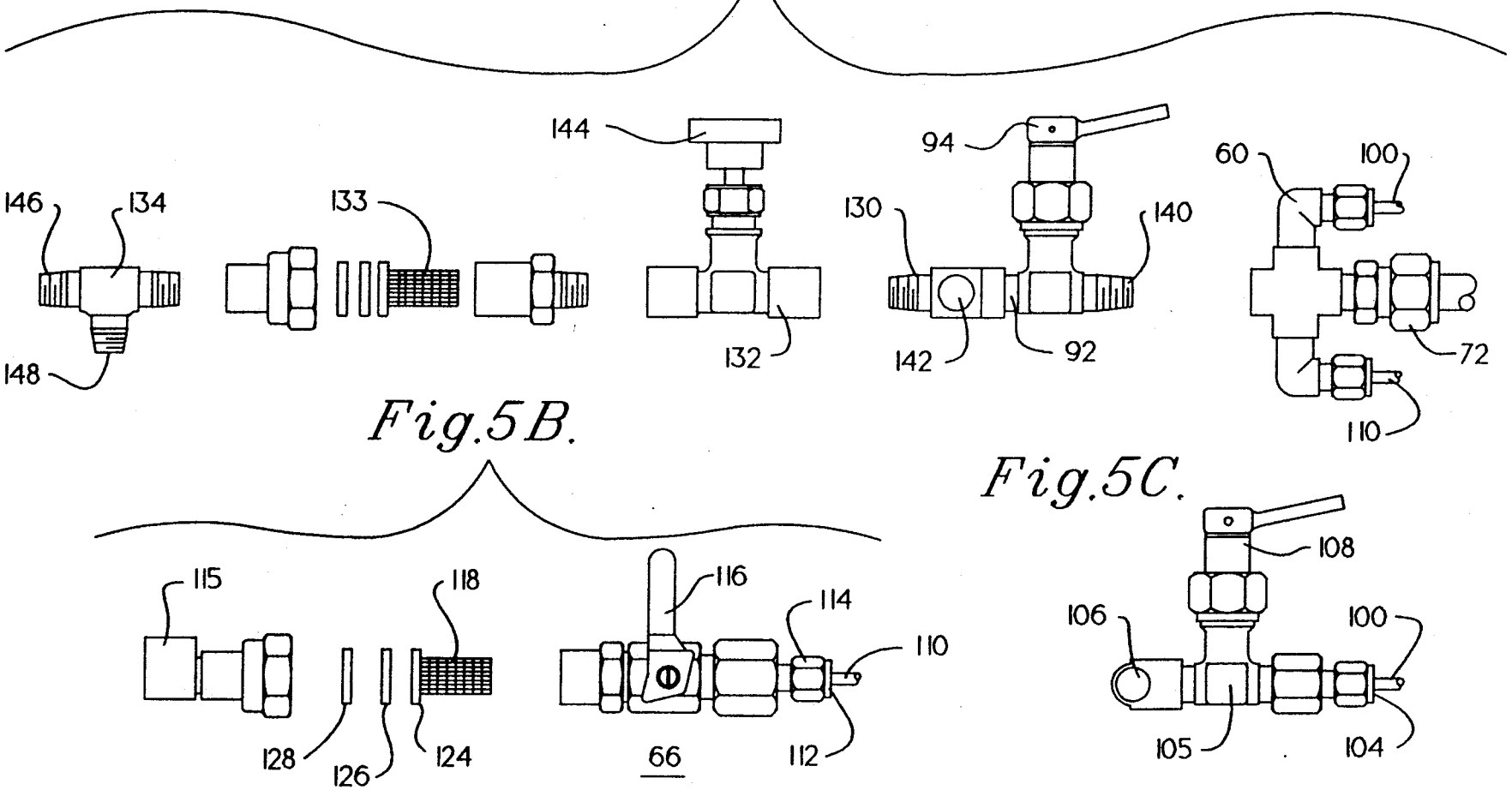
FIG. 5*a* is an exploded view of the primary portion of the hand-held dispensing assembly of FIG. 3.
FIG. 5*b* is an exploded view of the air flow control portion of the hand-held dispensing assembly of FIG. 3.
FIG. 5*c* is a side view of the secondary liquid flow control portion of the hand-held dispensing assembly of FIG. 3.
Figure 8:
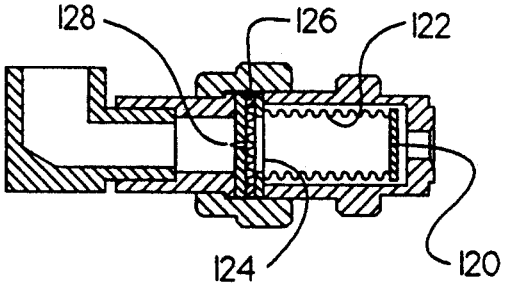
FIG. 8 is a cross-sectional view of a filter of the hand-held dispensing assembly of FIG. 3.

Referring to FIG. 5*b*, the gas outlet hose 110 has a second end which is connected to the input port 112 of a gas valve 116 and filter assembly 118 and secured thereto using a threaded hose connector 114. The gas valve 116 is preferably a ball valve, but may be of any suitable type of valve which is operable from an open position to a fully closed position to regulate flow through the gas outlet portion 66. As seen in FIG. 8, the filter 118 is preferably a cylindrical-type filter with a gas-impervious bottom 20, a previous Cylindrical side 122, and a ring-like top 124. An additional disk filter 126 may be placed over the ring-like top 24, and a gas-impervious disk 128 with a small opening in the center thereof must be placed over the disk filter 126. An output 115 of the gas outlet portion 66 is subsequently connected to a gas inlet port 148 of the main outlet portion 68, as seen in FIGS. 3, 5*a* and 5*b*.

Referring again to FIG. 6, the chemical outlet portion 62 of the hand-held dispensing assembly 16 receives chemicals 24 through the chemical inlet hose 40 which extends into the line separator 60 and out of a chemical outlet port 74 of the line separator 60 through an opening in a gas-tight washer 76 lodged in the port 74. Outlet port 92 of the chemical outlet portion 62 is connected to the main outlet portion 68 at a main chemical inlet 140. The main chemical inlet 140 is upstream of the gas inlet port 148. Intermediate the ports 74 and 92 a first chemical valve 94, which regulates the flow of chemical 24 through the chemical outlet portion 62, is provided. The first chemical valve 94 is preferably a toggle valve, but may be any other suitable type of valve which is operable between an open and fully closed positions.

The secondary chemical inlet hose 42, which extends through the hose separator 60 and out of a secondary chemical outlet port 78 of the hose separator 60, is thereby in fluid communication with the secondary chemical outlet hose 100. The secondary chemical outlet portion 64 receives chemicals 26 through the secondary chemical outlet hose 100. A threaded hose connector 80 extends around the secondary chemical outlet hose 100 as it leaves the secondary chemical outlet port 78 such that a gas-tight seal is formed around the secondary chemical outlet hose 100. The secondary chemical outlet hose is preferably formed from ⅛ inch diameter nylon tubing and, in a preferred embodiment, may be reinforced by positioning the ⅛ inch diameter tubing within larger 3/16 diameter nylon tubing. As seen in FIG. 5*c*, the other end of the secondary chemical outlet hose 100 is a connected to an input port 104 of a connector 105. An output port 106 of the connector 105 is then attached to a secondary chemical inlet 142 of the main output portion 68. A secondary chemical valve 108 is located intermediate the input port 104 and the output port 106 to regulate the flow of secondary chemical through the secondary chemical outlet portion 64. Similar to the first chemical valve 94, the secondary chemical valve 108 is preferably a toggle valve, but may be any other suitable type of valve which is operable between an open and fully closed positions.

Referring to FIG. 5*a*, the main outlet portion 68 includes a main chemical inlet section 130, a chemical shutoff section 132, a main gas inlet section 134, and a spray gun section 136 (FIG. 3). The main chemical inlet section 130 is preferably at an upstream end 138 of the main outlet portion 68, and includes the main chemical inlet 140 and the secondary chemical inlet 142. The chemical shutoff section 132 includes a chemical shutoff valve 144 which is operable between an open position and a fully closed position to regulate chemical and/or secondary chemical flow through the main outlet portion 68. The chemical shutoff valve 144 is preferably a needle valve, but any other suitable valve may be used. It is also preferred that the chemical shut-off valve 144 have a micrometer gauge (not shown) as a part thereof. A filter 133, similar to the filter 118, may be installed either upstream or downstream from the chemical shut-off valve 144.

The gas inlet section 134 is at a downstream end of the main outlet portion 68, and includes the main gas inlet 148 whereby gas may be inlet from the output 115 of the gas inlet portion 66 and flow through the interior of the spray gun section 136 where it is ultimately mixed with the chemical 24 and/or the secondary chemical 26.

The spray gun section 136, including a trigger assembly 150 and a nozzle or outlet 152, is attached to the outlet 146 of the gas inlet section 134. A tube, shown as a dashed line 160 in FIG. 3, extends through a gas-tight washer (not shown) within the chemical shutoff section 132 through the spray gun section 136. The end of the tube 160 is in a chamber (not shown) near the nozzle 152 whereby the gas and the chemical 24 and/or the secondary chemical 26 may be mixed. The spray gun section 136 is typically an off-the-shelf component and may be any standard type spray gun of suitable nature. Such a spray gun section 136, for example, is sold under the trademark Extendaban®, and could, for example, be 18"modified to a working pressure of 500 psi. Other spray guns may be an Extendaban® 8", a System III gun, or a Spraying Systems Gunjet.

The structure and operation of the dispensing apparatus 10 will now be explained. Normally, an operator such as an exterminator, will carry the hand-held dispensing assembly 16 with the tank assembly 12 in a harness (not shown). The first chemical valve 94, secondary chemical valve 108, gas valve 116, and chemical shut-off valve 144 will be closed and pressurized air will be contained in the upper portions 32, 34 of the tanks 20, 22.

The operator may use the dispensing apparatus 10 in a number of ways, depending on which valves the operator opens. If the operator opens only the gas valve 116 and then depresses the trigger assembly 150, gas will flow from the tank 20 within the gas inlet hose 44 external to both the chemical inlet hose 40 and the secondary chemical inlet hose 42. The gas will flow through the interior 82 of the hose separator 60, through the gas outlet portion 66, into the main outlet portion 68, through the main gas inlet 148, and out the nozzle or outlet 152. Such a function can be useful to direct a stream of gas into a crack or crevice, thereby blowing dirt or debris out of the crack or crevice and prepare it for chemical spraying. A rigid piece of tubing 154 may generally be attached to the outlet 152 during this operation to facilitate formation of a gas stream.

If the operator leaves the gas valve 116 closed and opens the chemical shutoff valve 144 as well as either the first chemical valve 94, the secondary chemical valve 108, or both the first chemical valve 94 and the secondary chemical valve 108, the chemical 24 and/or the secondary chemical 26 will flow out the tank 20 and/or the tank 22 and through the chemical inlet hose 40 and/or the secondary chemical inlet hose 42, respectively. The chemical 24 and/or the secondary chemical 26 will then flow through the hose separator 60 and through the chemical outlet hose 62 and/or the secondary chemical outlet hose 64, respectively.

If only one of the first chemical valve 94, or the secondary chemical valve 108 is opened, then the respective chemical 24 or secondary chemical 26 will flow into the main outlet portion 68 and out of the nozzle or outlet 152 when the nozzle assembly 150 is depressed. This function is useful to form a one-component, "wet" stream which can be used to saturate a particular area with a particular chemical. A solid stream tip or fan pattern tip (not shown) will generally be attached to the outlet 152 to facilitate formation of such a stream.

If both of the first chemical valve 94 and the secondary chemical valve 108 are open, then the chemical 24 and the secondary chemical 26 will both flow into and mix in the chemical inlet section 130 of the main outlet hose 68, and will thereafter flow out through the nozzle or outlet 152. This operation forms a two-component "wet" stream for saturating a particular area with a two component mixture. A solid stream tip or fan pattern tip (not shown) will generally be attached to the outlet 152 to facilitate formation of the stream.

As another option, and probably as the most commonly used option, the gas valve 116, the shutoff valve 144, and one or both of the first chemical valve 94, and the secondary chemical valve 108 may be opened. One or both of the chemical 24 and the secondary chemical 26 will then flow in a manner described above into the main outlet portion 68, and will be mixed with pressurized gas in the spray gun section 136 to form an aerosol spray which is sprayed out of the nozzle 152 as the trigger assembly 150 is depressed. This operation is useful for generating an aerosol chemical crack and crevice injection spray or a space spray which can quickly cover a relatively wide area.

It should be understood that as an operator is using the dispensing apparatus 10, any of the first chemical valve 94, secondary chemical valve 108, gas valve 116, or chemical shut-off valve 144 which are open during an operation may be adjusted to quickly and easily adjust the characteristics of flow leaving the nozzle 152. The adjustment is made particularly simple since each of the first chemical valve 94, secondary chemical valve 108, gas valve 116, and chemical shut-off valve 144 are located on the hand-held dispensing assembly 16 within easy reach of the operator. Furthermore, because the liquid shutoff valve 144 preferably has a micrometer reading, setting the device to predetermined mixtures is facilitated.

The arrangement of the chemical inlet hose 40 and the secondary chemical inlet hose 42 entirely within the gas inlet hose 44 from the tank 20 to the hose separator 60 assures that the ease or use of the dispensing apparatus 10 for the operator is optimized. The operator does not need to worry about the possibility of tangling several hoses or of getting tangled in several hoses, but still retains the advantages of a dispensing apparatus which can dispense multiple chemicals, either alone or mixed, and a pressurized gas, either alone or mixed with either of the chemicals.

It should be appreciated that various changes may be made to the invention and advantages obtained therefrom. For example, more or less tanks may be advantageously used, depending on the needs of an operator. If more tanks are used, parallel secondary chemical inlet hoses, outlet hoses, and valves, all configured in an analogous manner, will of course be added to the dispensing apparatus.

Figure 9:
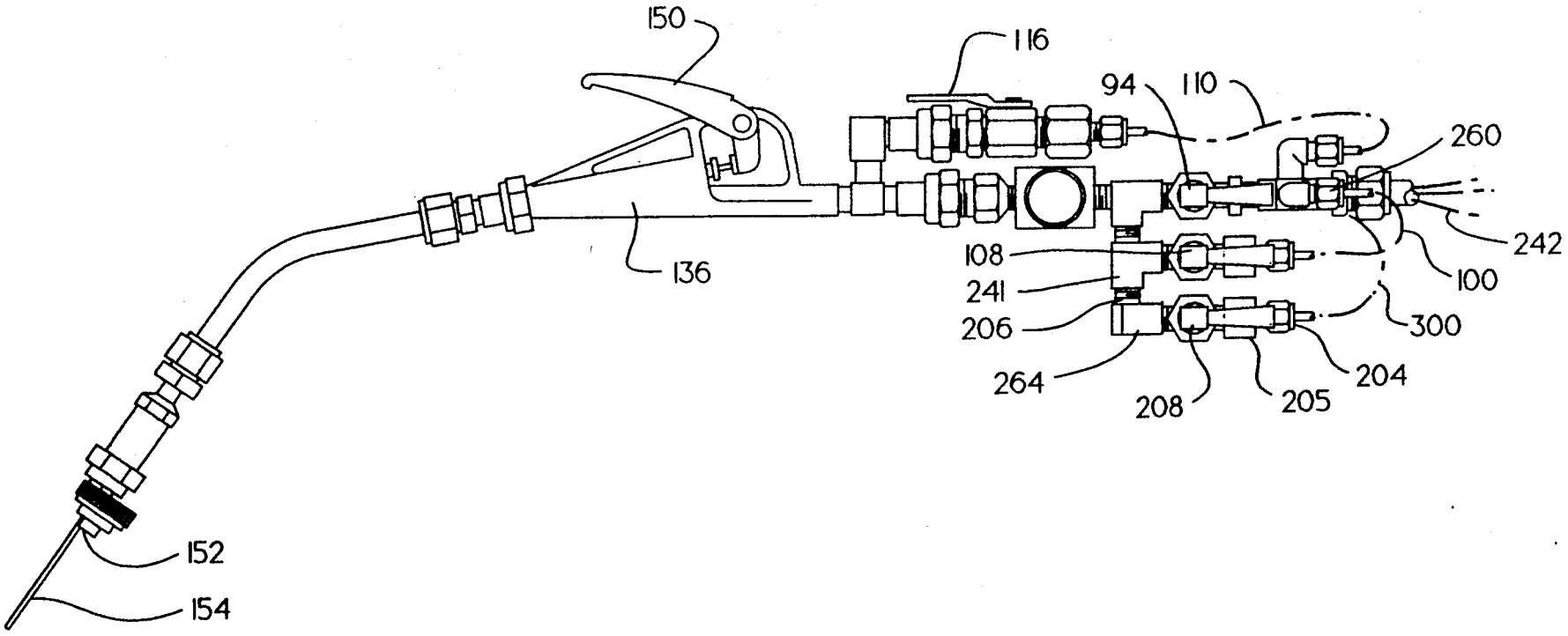
FIG. 9 is a side elevational view of the hand-held dispensing assembly for an apparatus which has two secondary tanks.

Such a configuration is illustrated in FIG. 9 wherein an additional secondary chemical outlet portion 264 is shown. An additional secondary chemical inlet hose 242 extends through a modified hose separator 260 having an additional chemical outlet port (not shown). Through that additional secondary chemical outlet port of the modified hose separator 260, the chemical inlet hose 242 is in fluid communication with an additional secondary chemical outlet hose 300. The additional secondary chemical outlet portion 264 receives chemicals (not shown) through the additional secondary chemical outlet hose 300. A threaded hose connector (not shown) extends around the additional secondary chemical outlet hose 300 as it leaves the additional secondary chemical outlet port (not shown) such that a gas-tight seal is formed around the additional secondary chemical outlet hose 300. The additional secondary chemical outlet hose is preferably formed from ⅛ inch diameter nylon tubing and, in a preferred embodiment, may be reinforced by positioning the ⅛ inch diameter tubing within larger 3/16 diameter nylon tubing.

The other end of the additional secondary chemical outlet hose 300 is connected to an input port 204 of a connector 205. An outlet port 206 of the connector 205 is attached to a connecting port 241. The secondary chemical may be conducted via connecting port 241 and port 142 to the main output portion 68. An additional secondary chemical valve 208 is located intermediate the inlet port 204 and the outlet port 206 to regulate the flow of secondary chemical through the additional secondary chemical outlet portion 264. Similar to the first chemical valve 94 and the secondary chemical valve 108, the additional secondary chemical valve 208 is preferably a toggle valve, but may be any other suitable type of valve which is operable between an open and fully closed positions. Operation of the device is similar to that as described above, with additional options provided by the open/close state of the additional secondary chemical valve 208.

An optional air tank (not shown) may be used in lieu of the hand pumping means 11 to supply air pressure to the primary tank 20 and should preferably have a working pressure of 250 psi.

The filter 118 may be removed from the gas outlet hose 66 and advantages still received therefrom, or different types of filters may be advantageously substituted for the filter 118. Likewise, filter 133 may be removed or replaced. Also, the dispensing apparatus 10 has been disclosed hereinabove as useful for dispensing pesticides, but it may readily and advantageously be adapted to other uses, such as dispensing a one-component or multi-component paint or various forms and compositions of cleaning agents. As such, it will be understood that variations and changes in the details of the apparatus which has been herein described and illustrated to explain the present invention may be made by those skilled in the art without departing from the spirit, principle, and scope of the present invention may be made by those skilled in the art without departing from the spirit, principle, and scope of the present invention may be made by those skilled in the art without departing from the spirit, principle, and scope of the present invention. Accordingly, it is expressly intended that all such equivalents, variations and changes therefrom which fall within the principle and scope of the present invention as described herein and defined in the claims be embraced thereby.

What is claimed is:

1. An apparatus for dispensing liquids and pressurized gas, comprising:

gas inlet hose means having an interior for conducting a pressurized gas therethrough;

liquid inlet hose means for conducting a primary liquid therethrough in the same direction as the pressurized gas is conducted, said liquid inlet hose means extending through said interior along the entire length of said gas inlet hose means;

a hose separator connected to a first end of said gas inlet hose means and a first end of said liquid inlet hose means;

a gas outlet hose means having a first end and a second end, said first end of said gas outlet hose means connected through said hose separator so as to be in fluid communication with said gas inlet hose means for further conducting the pressurized gas therethrough;

a liquid outlet hose means external to said gas outlet hose means, said liquid outlet hose means having a first end and a second end, said first end of said liquid outlet hose means connected through said hose separator so as to be in fluid communication with said liquid inlet hose means for further conducting the primary liquid therethrough; and a main outlet hose means connected to and in fluid communication with said second end of said liquid outlet hose means and said second end of said gas outlet hose means for conducting at least one of the pressurized gas and the primary liquid therethrough.

2. An apparatus as claimed in claim 1, further comprising a first valve means positioned within said liquid outlet hose means for regulating flow therethrough and a second valve means positioned within said gas outlet hose means for regulating flow therethrough.

3. An apparatus as claimed in claim 2, wherein said main outlet hose means includes an upstream end and a downstream end, said second end of said liquid outlet hose means being connected to said upstream end of said main outlet hose means and said second end of said gas outlet hose means being connected to said downstream end of said main outlet hose means.

4. An apparatus as claimed in claim 1 further comprising a tank for containing a supply of the primary liquid in a lower portion thereof and a supply of the pressurized gas in an upper portion thereof, wherein a second end of said gas inlet hose means is connected to said upper portion of said tank for conducting the pressurized gas therefrom and a second end of said liquid inlet hose means extends into said lower portion of said tank for conducting the primary liquid therefrom.

5. An apparatus as claimed in claim 4, further comprising a first valve means positioned within said liquid outlet hose means for regulating flow therethrough, and a second valve means positioned within said gas outlet hose means for regulating flow therethrough.

6. An apparatus as claimed in claim 5, wherein said main outlet hose means includes an upstream end and a downstream end, said second end of said liquid outlet hose means being connected to said upstream end of said main outlet hose means and said second end of said gas outlet hose means being connected to said downstream end of said main outlet hose means.

7. An apparatus as claimed in claim 1, further comprising a secondary liquid inlet hose means for conducting a secondary liquid therethrough, said secondary liquid inlet hose means extending through said interior of said gas inlet hose means wherein a first end of said secondary liquid inlet hose means is connected to said hose separator; and a secondary liquid outlet hose means having a first end and a second end, said secondary liquid outlet hose means being external to said gas outlet hose means, said first end of said secondary liquid outlet hose means connected to said hose separator so as to be in fluid communication with said secondary liquid inlet hose means for further conducting the secondary liquid therethrough, and wherein said second end of said secondary liquid outlet hose means is connected to said main outlet hose means.

8. An apparatus as claimed in claim 7, further comprising a first valve means positioned within said liquid outlet hose means for regulating flow therethrough, a second valve means positioned within said gas outlet hose means for regulating flow therethrough, and a third valve means positioned within said secondary liquid outlet hose means for regulating flow therethrough.

9. An apparatus as claimed in claim 8, wherein said main outlet hose means includes an upstream end and a downstream end, said second end of said liquid outlet hose means and said second end of said secondary liquid outlet hose means being connected to said upstream end of said main outlet hose means, and said second end of said gas outlet hose means being connected to said downstream end of said main outlet hose means.

10. An apparatus as claimed in claim 7 further comprising a primary tank for containing a supply of the primary liquid in a lower portion thereof and a supply of the pressurized gas in an upper portion thereof and a secondary tank for containing a supply of a secondary liquid in a lower portion thereof and a supply of the pressurized gas in an upper portion thereof, wherein a second end of said gas inlet hose means is connected to said upper portion of said priming tank for conducting the pressurized gas therefrom, a second end of said liquid inlet hose means extends into said lower portion of said primary tank for conducting the primary liquid therefrom, and a second end of said secondary liquid inlet hose means extends into said lower portion of said secondary tank for conducting the secondary liquid therefrom.

11. An apparatus as claimed in claim 10, further comprising a first valve means positioned within said liquid outlet hose means for regulating flow therethrough, a second valve means positioned within said gas outlet hose means for regulating flow therethrough, and a third valve means positioned within said secondary liquid outlet hose means for regulating flow therethrough.

12. An apparatus as claimed in claim 11, wherein said main outlet hose means includes an upstream end and a downstream end, said second end of said liquid outlet hose means and said second end of said secondary liquid outlet hose means being connected to said upstream end of said main outlet hose means, and said second end of said gas outlet hose means being connected to said downstream end of said main outlet hose means.

* * * * *

UNITED STATES PATENT AND TRADEMARK OFFICE

CERTIFICATE OF CORRECTION

PATENT NO. : 5,221,026
DATED : June 22, 1993
INVENTOR(S) : Monte Williams

It is certified that error appears in the above-indentified patent and that said Letters Patent is hereby corrected as shown below:

On the title page, in the Abstract, line 1, after "for" insert --dispensing--.

Col. 5, line 51, delete "20" and substitute therefor --120--.

Col. 5, line 51, delete "previous Cylindrical" and substitute therefor --pervious cylindrical--.

Col. 5, line 53, delete "24" and substitute therefor --124--.

Col. 9, lines 30-34, delete "may be made by those skilled in the art without departing from the spirit, principal, and scope of the present invention may be made by those skilled in the art without departing from the spirit, principal, and scope of the present invention"

Col. 11, line 9, delete "priming" and substitute therefor --primary--.

Signed and Sealed this

Nineteenth Day of April, 1994

Bruce Lehman

*Attest:*

BRUCE LEHMAN

*Attesting Officer*

*Commissioner of Patents and Trademarks*